US005316498A

United States Patent [19]

Hooper

[11] Patent Number: 5,316,498

[45] Date of Patent: May 31, 1994

[54] BATTERY BOOSTER CABLE STORAGE SYSTEM

[76] Inventor: Joseph Hooper, 5201 Branson Rd., Poteau, Okla. 74953

[21] Appl. No.: 75,377

[22] Filed: Jun. 14, 1993

[51] Int. Cl.[5] ..... H01R 11/24

[52] U.S. Cl. ..... 439/501; 439/504; 206/328; 206/388; 206/805

[58] Field of Search ..... 439/501, 504; 206/328, 206/388, 805

[56] References Cited

U.S. PATENT DOCUMENTS

| | | | |
|---|---|---|---|
| 4,037,720 | 7/1977 | McGurk | 206/328 |
| 4,758,188 | 7/1988 | Yates | 439/759 |
| 4,826,457 | 5/1989 | Varatta | 439/755 |
| 4,923,415 | 5/1990 | Lee | 439/504 |
| 4,929,199 | 5/1990 | McKinnon | 439/759 |
| 4,934,957 | 6/1990 | Bellusci | 439/504 |
| 4,971,577 | 11/1990 | Scheckel | 439/504 |
| 4,975,089 | 12/1990 | Lee | 439/755 |
| 5,168,128 | 12/1992 | Thomsen | 439/501 |

*Primary Examiner*—Gary F. Paumen
*Attorney, Agent, or Firm*—Charles C. Logan, II

[57] ABSTRACT

A battery booster cable storage system that takes two elongated battery booster cables each having a predetermined length L and folds them back and forth upon themselves into a predetermined shape that is substantially linear and having a folded length no greater than L/3. A closed loop elastic member is secured to one of the alligator clamp assemblies at each end of the substantially linear folded shape. A gripping member may be secured to the closed loop elastic member and there is provided a cable support member that removably receives the gripping member.

7 Claims, 3 Drawing Sheets

BATTERY BOOSTER CABLE STORAGE SYSTEM

BACKGROUND OF THE INVENTION

The invention relates to battery bootser cables and more specifically a system for storing them when they are not in use.

Presently battery booster cables are packaged and sold in a coiled shape in which they have been wound. A person buying such a battery booster cable will normally store it in the trunk of his vehicle or in his garage wound in a coiled configuration. Initially the cables are coiled into a compact package, but after opening the package for use the coiled cables are rarely recoiled into the original compact size. The cables can never be retained in a neat compact shape with out using a device to retain them. There is presently no known method of mounting a coiled battery booster cable in trunk of an automobile.

It is an object of the invention to provide a novel battery booster cable storage system that allows the two battery booster cables to be folded back and forth upon themselves into a predetermined shape that is substantially linear and to also be retained in this configuration.

It is also an object of the invention to provide a novel battery booster cable storage system that allows the folded battery booster cables to be more easily stored in the trunk of an automobile when not in use.

It is another object of the invention to provide a novel battery booster cable storage system that can be utilized with a battery booster cable support member that can be installed in the trunk of an automobile.

It is a further object of the invention to provide a novel battery booster cable storage system that is economical to manufacture and market.

SUMMARY OF THE INVENTION

The novel battery booster cable storage system has been designed to provide a convenient way of storing two elongated battery booster cables in the trunk of a vehicle when they are not in use. Often times, they are not used more than one or twice in a year.

The two elongated battery booster cables each have a predetermined length L. The battery booster cables are folded back and forth upon themselves into a predetermined shape that is substantially linear and having a folded length no greater than L/3. In this folded configuration, the front end of two of the alligator clamp assemblies will be adjacent one end of the folded configuration and the other two alligator clamps will have their front ends adjacent the other end of the folded configuration.

Different embodiments allow the folded battery booster cables to be restricted to their folded shape. All three of these embodiments utilize a closed loop elastic member such as a bungy cord that is looped around the respective alligator clamp assemblies and the folded length of battery booster cables. One option is to have the closed loop elastic member pass through the coiled spring of the alligator clamp assemblies. Another version requires an aperture in the handles of two of the alligator clamp assemblies and the closed loop elastic member passes through these apertures. The third embodiment provides for a flange formed on the insulator hand grip of two of the alligator clamp assemblies and an aperture is formed in that flange and a separate closed loop elastic member passes through each of those apertures.

Due to the fact that the front end of the alligator clamp assemblies are adjacent the opposite ends of the folded battery booster cables, the alligator clamps can be used to clamp the folded structure to a flange or gusset or other protruding structure found in that area of the trunk up behind the back seat and therefore utilize an area not normally used for storage.

The closed loop elastic member may also have a triangularly shaped gripping member secured thereon and this provides assistance in stretching the elastic member and pulling it out around the folded thickness of the battery booster cables. Triangularly shaped gripping members may also be utilized with one or more cable support members that can be installed in remote out-of-the-way areas of the trunk of an automobile. These cable support members would have mating triangularly shaped slots to removably receive the triangularly shaped gripping members, thereby providing a structure for hanging the folded battery booster cables in a remote area of the trunk.

DESCRIPTION OF THE PREFERRED EMBODIMENT

Figure 1:
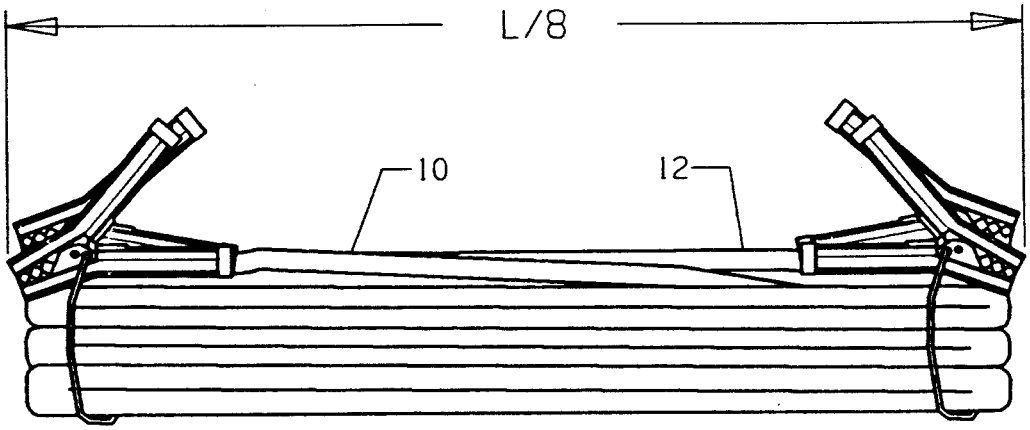
FIG. 1 is a schematic side elevation view illustrating the two elongated battery booster cables folded back and forth upon themselves into a predetermined shape that is substantially linear.
Figure 2:
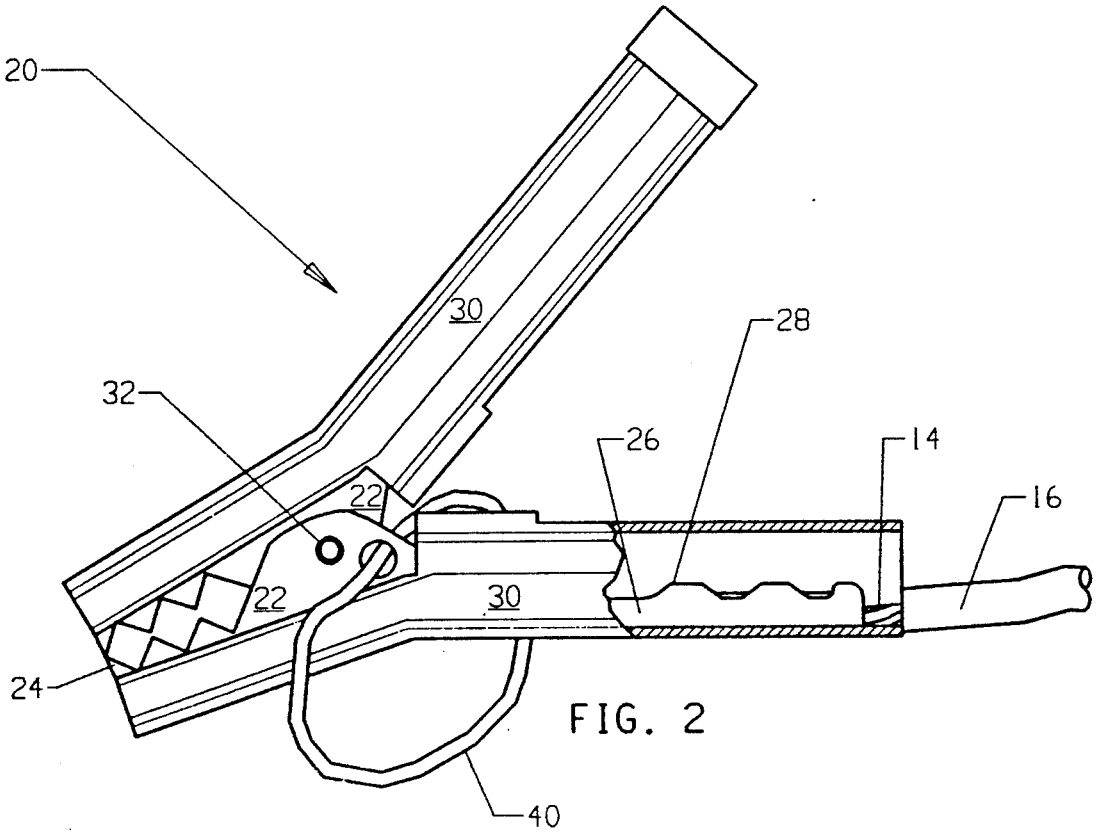
FIG. 2 is a side elevation view of one of the alligator clamps with portions broken away for clarity.

The novel battery booster cable storage system will now be described by referring to FIGS. 1 and 2 of the drawings. A pair of elongated battery booster cables 10 and 12 normally have a predetermined elongated length L. In FIG. 1 they are illustrated as having been folded back and forth upon each other into a predetermined shape that is substantially linear and having a folded length approximately equal to L/8. Each of the battery booster cables 10 and 12 have a stranded wire electrical conductor 14 that extends its length and it is surrounded by a layer of insulation 16. In a preferred embodiment, the two battery booster cables 10 and 12 would have their insulation connected together along at least 70 percent of their length.

An alligator type clamp 20 is secured to each end of the respective battery booster cables. These clamps have two substantially identical elongated members each having a jaw 22 with teeth 24 at its one end and a handle 26 at its other end. Handle 26 has gripping fingers 28 that are bent over and pressed around the end of the stranded conductor wire 14. An insulator grip 30 covers the end of handle 26. A pivot pin 32 passes through a coiled spring 34 that functions to keep the two jaws clamped together. In the embodiment illustrated in FIG. 2, an aperture 36 is formed in one of the handles 26 and a closed loop elastic member 40, such a bungy cord, passes through that aperture.

Figure 3:
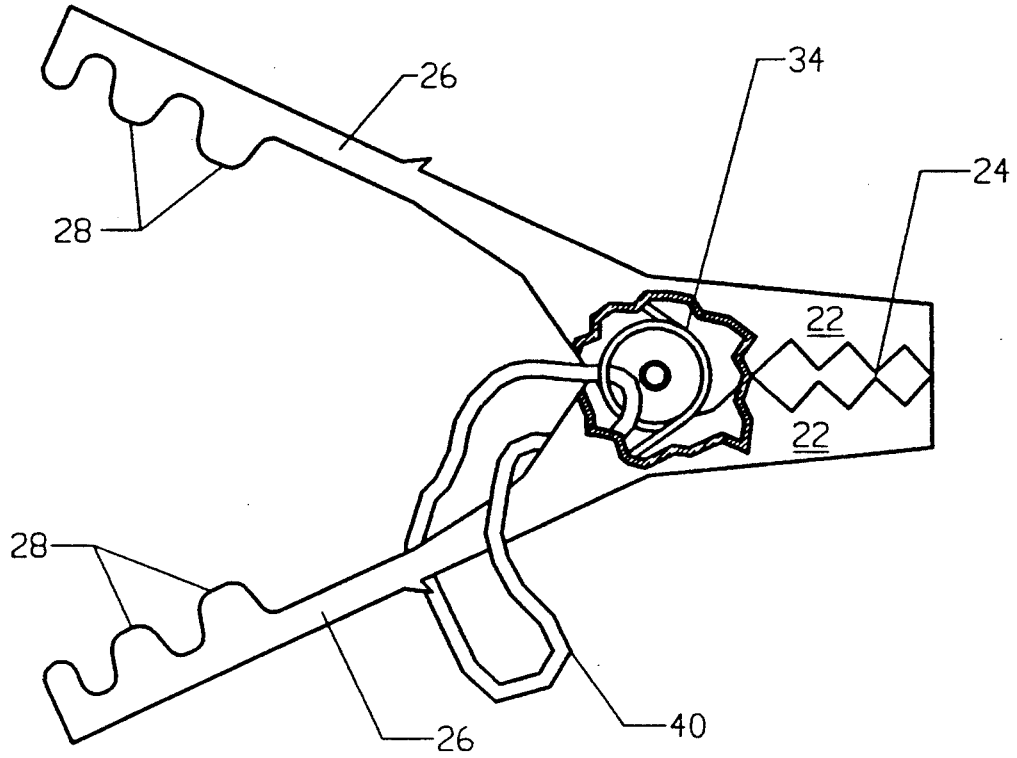
FIG. 3 is a side elevation view showing an alternative embodiment that has the closed loop elastic member passing through the center of the coiled spring of the alligator clamp.
Figure 4:
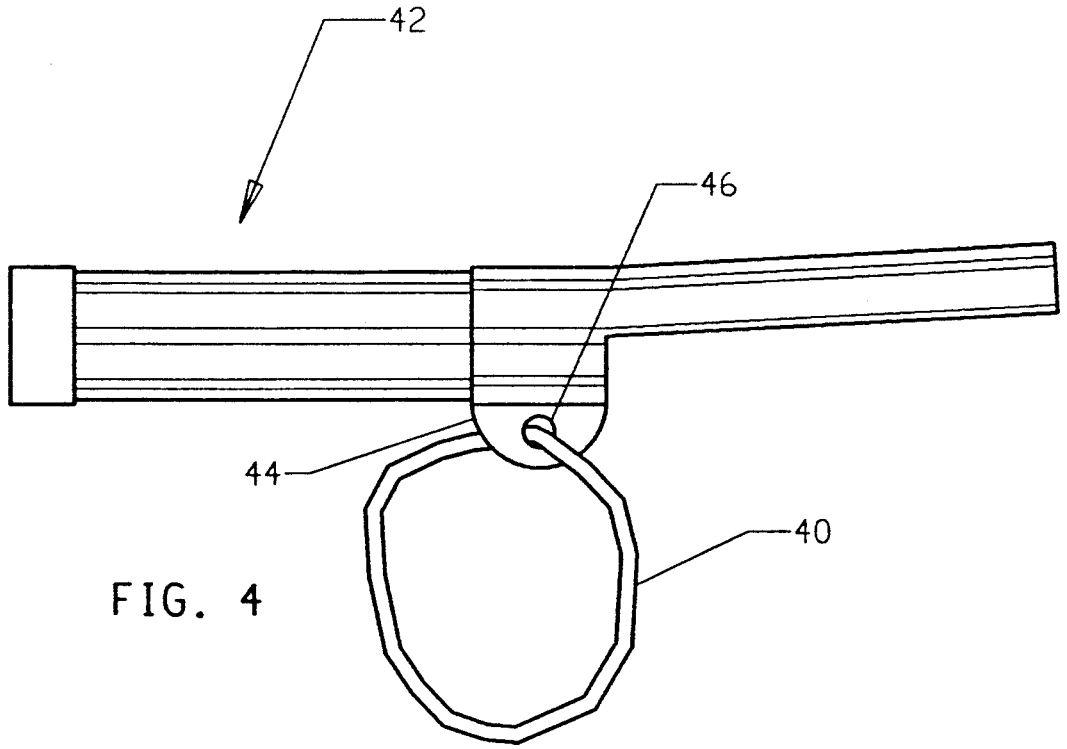
FIG. 4 is a second alternative embodiment that illustrates the insulator grip for the alligator clamp having a flange with an aperture through which passes the closed loop elastic member.

A first alternative embodiment is illustrated in FIG. 3. The closed loop elastic member 40 passes through the interior of coil spring 34. In the second alternative embodiment shown in FIG. 4, the insulator grip 42 has a flange 42 extending from its one side. An aperture 46 is formed therein and the closed loop elastic member 40 passes therethrough.

Figure 5:
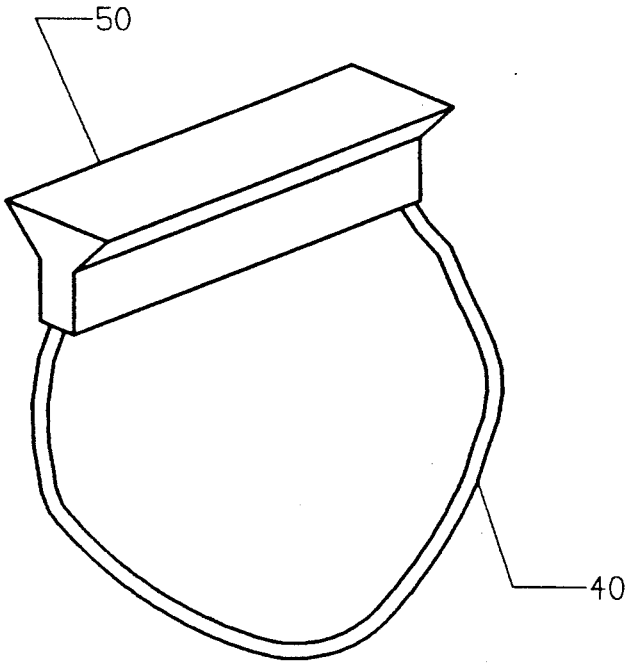
FIG. 5 is a perspective view illustrating a triangularly shaped gripping member secured to the closed loop elastic member.
Figure 6:
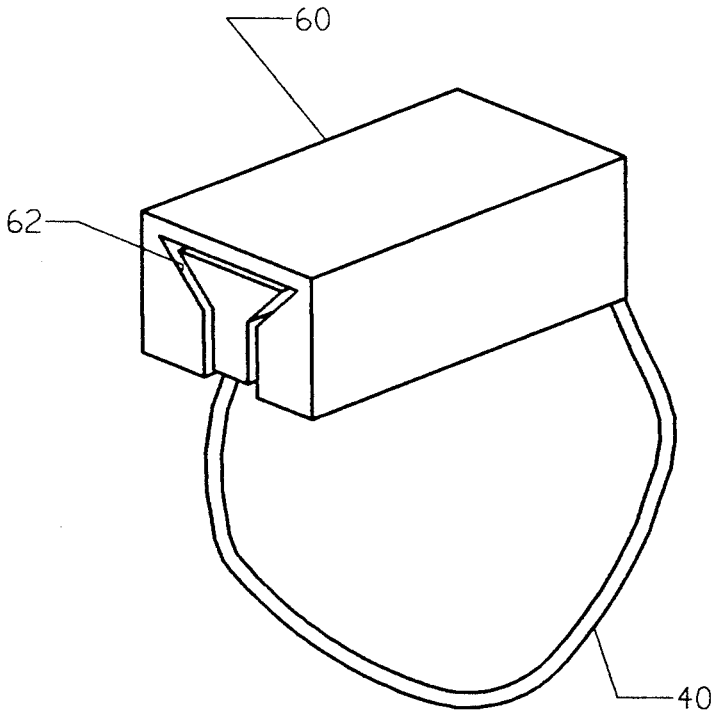
FIG. 6 is a perspective view illustrating a cable support member that removably receives the gripping member illustrated in FIG. 5.

In all of the above discussed embodiments, the closed loop elastic member 40 may have a substantially triangularly shaped gripping member 50 secured thereto (see FIG. 5). This makes it easier to grab the elastic member and stretch it while pulling it around the folded thickness of the battery booster cables. One or more cable support members 60 can be secured by adhesive or other means to a surface in the interior of the trunk of an automobile. Cable support member 60 has a triangularly shaped slot 62 that removably receives gripping member 50. This allows the folded battery booster cables to be hung in a remote area of an automobile trunk.

What is claimed is:

1. A battery booster cable storage system comprising:

two elongated battery booster cables each having a predetermined length L;

each of said battery booster cables having a stranded wire electrical conductor that extends its length and they are each surrounded by a layer of insulation, said stranded wire electrical conductors having a first end and a second end;

four alligator clamp assemblies each formed from a pair of elongated handles having a jaw with teeth formed on one of their ends, a pivot pin connects said pair of handles intermediate their length, said pivot pin passes through a coiled spring that functions to keep said jaws clamped together, an insulator hand grip is removably received on each handle;

the respective first and second ends of said stranded wire electrical conductors being connected to only one of the handles of an alligator clamp assembly;

said battery booster cables being folded back and forth into a predetermined shape that is substantially linear and having a folded length no greater than L/3; and means for holding said folded booster cables in said substantially linear configuration comprising a closed loop elastic member directly secured to one of the alligator clamp assemblies at each end of said substantially linear folded shape.

2. A battery booster cable storage system as recited in claim 1 wherein the jaws of two of said alligator clamp assemblies are located adjacent the respective ends of said predetermined substantially linear folded shape.

3. A battery booster cable storage system as recited in claim 2 wherein said means for holding said folded booster cables in said substantially linear configuration comprises a closed loop elastic member that passes through the coiled spring of one of the alligator clamp assemblies at each end of said substantially linear folded shape.

4. A battery booster cable storage system as recited in claim 2 wherein said means for holding said folded booster cables in said substantially linear configuration comprises an aperture in the handle of one of the alligator clamp assemblies at each end of said substantially linear folded shape and a closed loop elastic member passing through said aperture.

5. A battery booster cable storage system as recited in claim 2 wherein said means for holding said folded booster cables in said substantially linear configuration comprises a flange formed on the insulator hand grip of one of the alligator clamp assemblies at each end of said substantially linear folded shape, an aperture is formed in each of said flanges and a closed loop elastic member passing through said aperture.

6. A battery booster cable storage system as recited in claim 1 wherein a substantially triangularly shaped gripping member is secured to said closed loop elastic member.

7. A battery booster cable storage system as recited in claim 6 further comprising a cable support member having a substantially triangularly shaped aperture that removably receives said substantially triangularly shaped gripping member.

* * * * *